US009214746B2

(12) United States Patent
Kobayashi et al.

(10) Patent No.: US 9,214,746 B2
(45) Date of Patent: Dec. 15, 2015

(54) CONTACT TERMINAL INTERPOSED BETWEEN TWO CONTACT TARGETS

(75) Inventors: Takao Kobayashi, Kanagawa (JP); Michiya Masuda, Kanagawa (JP)

(73) Assignee: NHK Spring Co., Ltd., Yokohama-shi (JP)

( * ) Notice: Subject to any disclaimer, the term of this patent is extended or adjusted under 35 U.S.C. 154(b) by 0 days.

(21) Appl. No.: 14/345,043

(22) PCT Filed: Sep. 13, 2012

(86) PCT No.: PCT/JP2012/073483

§ 371 (c)(1), (2), (4) Date: Mar. 14, 2014

(87) PCT Pub. No.: WO2013/039154

PCT Pub. Date: Mar. 21, 2013

(65) Prior Publication Data

US 2015/0038026 A1 Feb. 5, 2015

(30) Foreign Application Priority Data

Sep. 16, 2011 (JP) ..... 2011-203518

(51) Int. Cl.
*H01R 9/24* (2006.01)
*H01R 13/02* (2006.01)
(Continued)

(52) U.S. Cl.
CPC ..... *H01R 12/714* (2013.01); *H01R 13/2407* (2013.01); *H01R 13/2435* (2013.01); *H01R 13/62* (2013.01); *H01R 12/7082* (2013.01)

(58) Field of Classification Search
CPC ..... H01R 13/22; H01R 13/28; H01R 23/722; H01R 23/72; H01R 9/096; H01R 4/4809
USPC ..... 439/889, 289, 66, 861, 82, 71
See application file for complete search history.

(56) References Cited

U.S. PATENT DOCUMENTS 4,838,801 A * 6/1989 Bertoglio et al. ..... 439/83
5,192,213 A * 3/1993 Kosugi et al. ..... 439/66
(Continued)

FOREIGN PATENT DOCUMENTS

JP 07-135032 A 5/1995
JP 09-270288 A 10/1997
(Continued)

OTHER PUBLICATIONS

International Search Report dated Dec. 18, 2012, issued for PCT/JP2012/073483.

*Primary Examiner* — Hae Moon Hyeon
(74) *Attorney, Agent, or Firm* — Locke Lord LLP

(57) ABSTRACT

A contact terminal interposed between two contact targets so as to provide electrical conduction between the two contact targets includes: a first conductive member including a salient portion composed of a plurality of inclined surfaces, and a first contact portion that is provided at an end different from the salient portion and contacts an electrode of one of the contact targets; and a second conductive member including a second contact portion that has a curved shape and contacts an electrode of another one of the contact targets, a plurality of elastic portions each of which extends in a band shape along the curved shape from the second contact portion and is elastically deformable, and sliding contact portions each of which is provided at a leading end of one of the elastic portions and slidably contacts a corresponding one of the inclined surfaces.

6 Claims, 10 Drawing Sheets

(51) Int. Cl.

| | |
|---|---|
| ***H01R 12/71*** | (2011.01) |
| ***H01R 13/24*** | (2006.01) |
| ***H01R 13/62*** | (2006.01) |
| *H01R 12/70* | (2011.01) |

(56) References Cited

U.S. PATENT DOCUMENTS

| | | | | |
|---|---|---|---|---|
| 5,215,472 | A * | 6/1993 | DelPrete et al. | 439/71 |
| 5,362,241 | A * | 11/1994 | Matsuoka et al. | 439/66 |
| 5,823,830 | A * | 10/1998 | Wurster | 439/751 |
| 6,241,560 | B1 * | 6/2001 | Furusawa et al. | 439/700 |
| 7,008,272 | B2 * | 3/2006 | Blossfeld | 439/751 |
| 7,083,434 | B1 * | 8/2006 | Blossfeld | 439/82 |
| 7,097,485 | B1 * | 8/2006 | Wang et al. | 439/289 |
| 7,201,584 | B1 * | 4/2007 | Ju et al. | 439/71 |
| 7,377,823 | B2 * | 5/2008 | Chen | 439/751 |
| 7,695,286 | B2 | 4/2010 | Swart et al. | |
| 7,794,237 | B1 * | 9/2010 | Terhune, IV | 439/71 |
| 2005/0250247 | A1 | 11/2005 | Augustin et al. | |
| 2006/0134950 | A1 | 6/2006 | Liao et al. | |
| 2008/0182436 | A1 | 7/2008 | Rathburn | |
| 2010/0029100 | A1 | 2/2010 | Ichimura et al. | |

FOREIGN PATENT DOCUMENTS

| | | | |
|---|---|---|---|
| JP | 2005-322902 | A | 11/2005 |
| JP | 3118872 | U | 1/2006 |
| JP | 2006-086109 | A | 3/2006 |
| JP | 2008-021639 | A | 1/2008 |
| JP | 2008-198597 | A | 8/2008 |
| JP | 2010-056069 | A | 3/2010 |
| JP | 2010-524180 | A | 7/2010 |
| JP | 2010-539671 | A | 12/2010 |
| WO | WO-2008/122005 | A2 | 10/2008 |
| WO | WO-2009/039194 | A1 | 3/2009 |

* cited by examiner

CONTACT TERMINAL INTERPOSED BETWEEN TWO CONTACT TARGETS

FIELD

The present invention relates to a contact terminal interposed between two contact targets so as to provide electrical conduction between the two contact targets.

BACKGROUND

A power module has so far been an important device for energy saving that is used in a wide range of fields from power control to motor control, for example, for industrial use and for automotive use. The power module includes a substrate on which a plurality of semiconductor chips are mounted, and a plurality of contact terminals that contact the respective semiconductors of the substrate to perform input and output of power.

The contact terminals are required to ensure electrical conduction between an external circuit substrate and the substrate of the power module. To meet this demand, contact terminals are disclosed (refer to Patent Literature 1 to Patent Literature 4, for example), each of which can conduct electricity by employing an elastically deformable contact spring, contacting the respective substrates as contact targets, and applying an elastic force between the substrates. The employed contact spring can compensate changes in distance between the conductors due to, for example, variations in the distance between the conductors, temperature change, and warping of the substrates, and thus can maintain a contact state between the two contact targets.

Contact terminals are also disclosed (refer to Patent Literature 5 and Patent Literature 6, for example), each of which has a curved shape for holding a bar-like or plate-like conductive member. A contact terminal is also disclosed (refer to Patent Literature 7, for example), in which two curved beams contact each other at ends of the contact terminal, and the contact portions slide on each other according to a load applied from a substrate as a contact target so as to allow the contact terminal to expand and contract.

CITATION LIST

Patent Literature

Patent Literature 1: Japanese Patent Application Laid-open No. 2005-322902

Patent Literature 2: Japanese Patent Application Laid-open No. 2008-198597

Patent Literature 3: Japanese Patent Application Laid-open No. 2006-86109

Patent Literature 4: Japanese Patent Application Laid-open No. 2008-21639

Patent Literature 5: Japanese Utility Model Registration Publication No. 3118872

Patent Literature 6: Japanese Patent Application Laid-open No. 7-135032

Patent Literature 7: Japanese Translation of PCT International Application Publication No. 2010-539671

SUMMARY

Technical Problem

In recent years, electrical components having power modules have been desired to be smaller and more efficient, and thus, a demand exists for small contact terminals that allow a large current to flow and generate little resistance heat. In particular, connectors mounted, for example, on an automobile need to allow a large current to flow and provide electrical conductivity in a stable manner even when vibration occurs.

However, in the conventional contact terminals disclosed by Patent Literature 1 to Patent Literature 4, when a distance in the direction of contact between the contact terminals and the substrate is reduced, or a distance (pitch) between the contact terminals is made smaller (narrower) to meet the need for downsizing, an area for elastic deformation decreases, so that a space for elastically deforming the contact terminals cannot sufficiently be secured. Thus, the contact terminals potentially fail in sufficiently following the changes in the distance between the conductors. Reducing the thickness of the contact terminals to ensure the elastic deformation reduces a conducting cross-sectional area through which a current is conducted, thus increasing resistance. This increases the amount of heat generation due to the resistance heat generation, and thereby raises the temperature around the contact terminals. Thus, the substrate, for example, is potentially subject to thermal deformation depending on the circumstances.

The curved shape of each of the contact terminals disclosed by Patent Literature 5 and Patent Literature 6 is intended to hold the bar-like or plate-like conductive member. To expand and contract the entire contact terminal, a shape needs to be formed that allows elastic deformation, such as those illustrated in Patent Literature 1 to Patent Literature 4 mentioned above.

A contact terminal disclosed by Patent Literature 7 can reduce the distance in the direction of contact between the contact terminal and the substrate while securing the area for elastic deformation. However, a sliding distance needs to be secured in accordance with a distance for expanding and contracting the contact terminal, and thus, the contact terminal is not suitable for a downsized device. In addition, the contact terminal has a high resistance value because paths passing through two beams serve as conductive paths of a current, so that the amount of heat generation due to the resistance heat generation potentially increases, and thereby raises the temperature around the contact terminals.

The present invention has been made in view of the above description, and an object thereof is to provide a contact terminal that can achieve downsizing while maintaining required characteristics, such as elasticity and conductivity.

Solution to Problem

To solve the problem described above and achieve the object, a contact terminal according to the present invention is interposed between two contact targets so as to provide electrical conduction between the two contact targets, and includes: a first conductive member including a salient portion composed of a plurality of inclined surfaces, and a first contact portion that is provided at an end different from the salient portion and contacts an electrode of one of the contact targets; and a second conductive member including a second contact portion that has a curved shape and contacts an electrode of another one of the contact targets, a plurality of elastic portions each of which extends in a band shape along the curved shape from the second contact portion and is elastically deformable, and sliding contact portions each of which is provided at a leading end of one of the elastic portions and slidably contacts a corresponding one of the inclined surfaces.

Moreover, in the above-described contact terminal according to the present invention, the elastic portions extend along the curved shape from the second contact portion in a same shape.

Moreover, in the above-described contact terminal according to the present invention, one of the inclined surfaces and another one of the inclined surfaces form an angle of 30° or more.

Moreover, in the above-described contact terminal according to the present invention, the first conductive member includes a restricting portion that is provided between the inclined surfaces and the first contact portion, and projects from the inclined surface side to restrict a movement amount of the second conductive member.

Moreover, in the above-described contact terminal according to the present invention, the one of the contact targets includes a hollow portion with an electrode formed on a surface of the hollow portion, and the first contact portion extends in a plate shape with a same width as that of the hollow portion, and comprises a hole portion running through in a direction orthogonal to a surface of the plate shape.

Moreover, the above-described contact terminal according to the present invention includes an elastic member that is arranged in an area surrounded by the first and the second conductive members in a state in which the first and the second conductive members contact each other, and applies a pressing force toward the first and the second conductive members.

Advantageous Effects of Invention

According to the present invention, a contact terminal formed using electrically conductive members is allowed to expand and contract in an axis line direction passing through a first contact portion and a second contact portion while housing a first conductive member in an internal space of a second conductive member. Thus, an effect is provided that downsizing can be achieved while required characteristics, such as elasticity and conductivity, are maintained.

DESCRIPTION OF EMBODIMENTS

Figure 1:
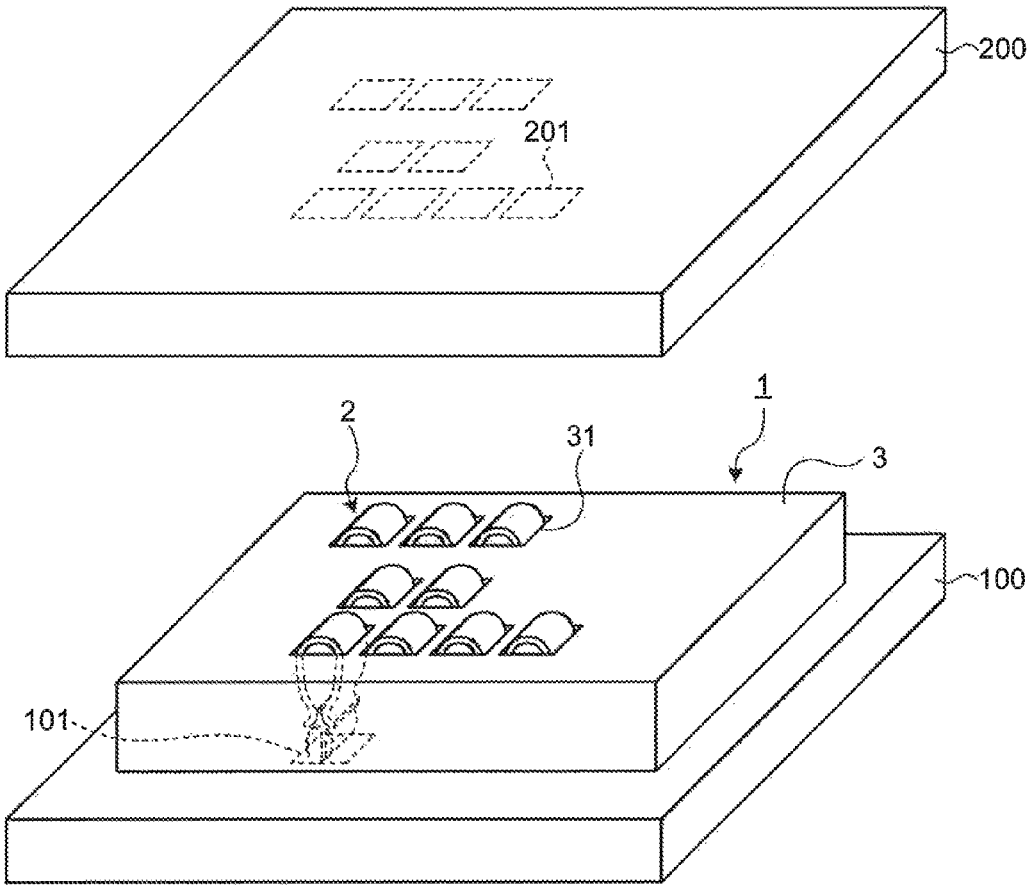
FIG. 1 is a perspective view schematically illustrating a configuration of a contact terminal unit including contact terminals according to a first embodiment of the present invention.

Embodiments for carrying out the present invention will be described below together with the accompanying drawings. The present invention is not limited by the following embodiments. The drawings to be referred to in the following description merely schematically illustrate shapes, sizes, and positional relations to the extent of allowing the details of the present invention to be understood. In other words, the present invention is not limited to the shapes, sizes, and positional relations illustrated in the drawings.

First Embodiment

FIG. 1 is a perspective view schematically illustrating a configuration of a contact terminal unit including contact terminals according to a first embodiment of the present invention. This contact terminal unit 1 illustrated in FIG. 1 is interposed between two contact targets so as to provide electrical conduction between the two contact targets. The contact terminal unit 1 illustrated in FIG. 1 is placed on a substrate 100 on which a plurality of semiconductor chips are mounted, and includes a plurality of contact terminals 2 each of which contacts, at both ends thereof, an electrode 101 of one of the semiconductor chips of the substrate 100 and an electrode 201 of a substrate 200, and a contact terminal holder 3 that holds the contact terminals 2. The configuration in which the contact terminal unit 1 is placed on the substrate 100 serves as a power module. The two contact targets are the substrate 100 and the substrate 200.

The substrate 100 is formed using insulating resin or an insulating material, such as silicon or ceramic, and has the semiconductor chips each having a predetermined function and the electrodes 101 contacting the semiconductor chips. The electrodes 101 are patterned using, for example, copper to form a circuit pattern for transmitting electric signals to, for example, the semiconductor chips mounted on the substrate 100.

Each of the semiconductor chips is built of semiconductor elements, such as diodes, transistors, and insulated gate bipolar transistors (IGBTs). A plurality of such semiconductor chips are provided on the substrate 100 in accordance with an intended use.

Figure 2:
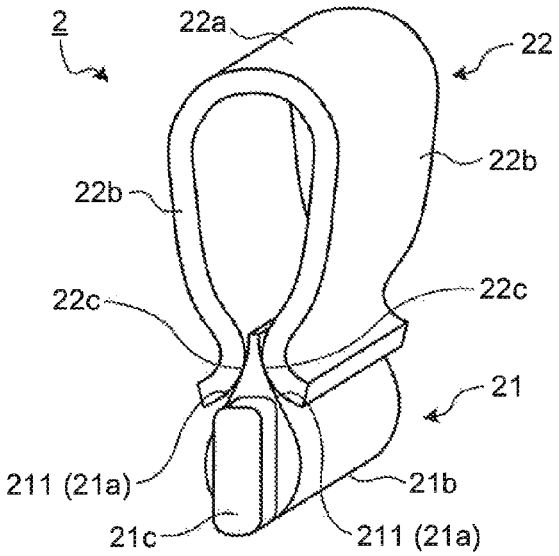
FIG. 2 is a perspective view schematically illustrating a configuration of one of the contact terminals according to the first embodiment of the present invention.
Figure 3:
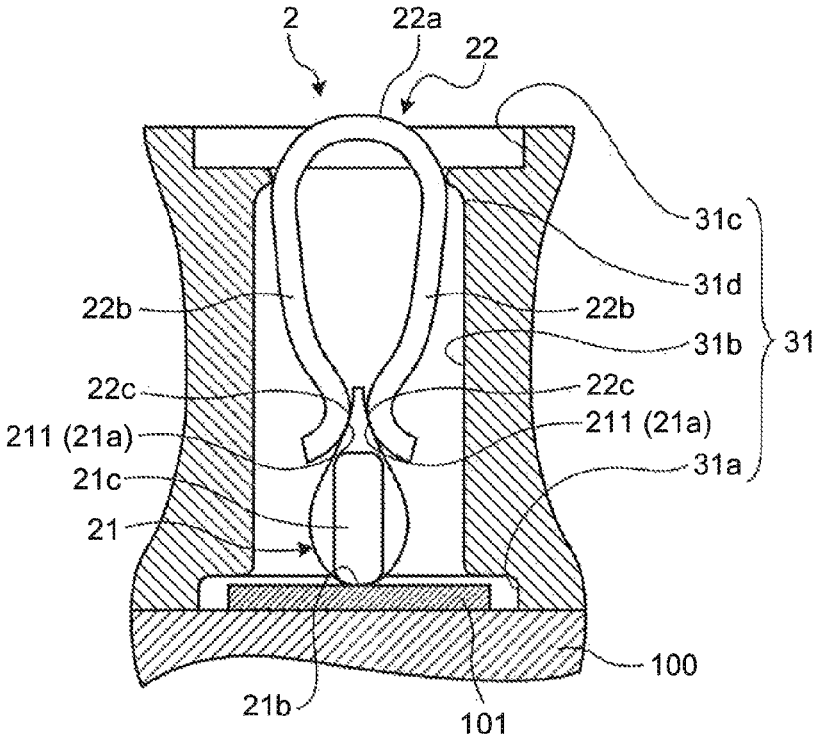
FIG. 3 is a partial cross-sectional view schematically illustrating a configuration of the contact terminal and a contact terminal holder that holds the contact terminal according to the first embodiment of the present invention.
Figure 4:
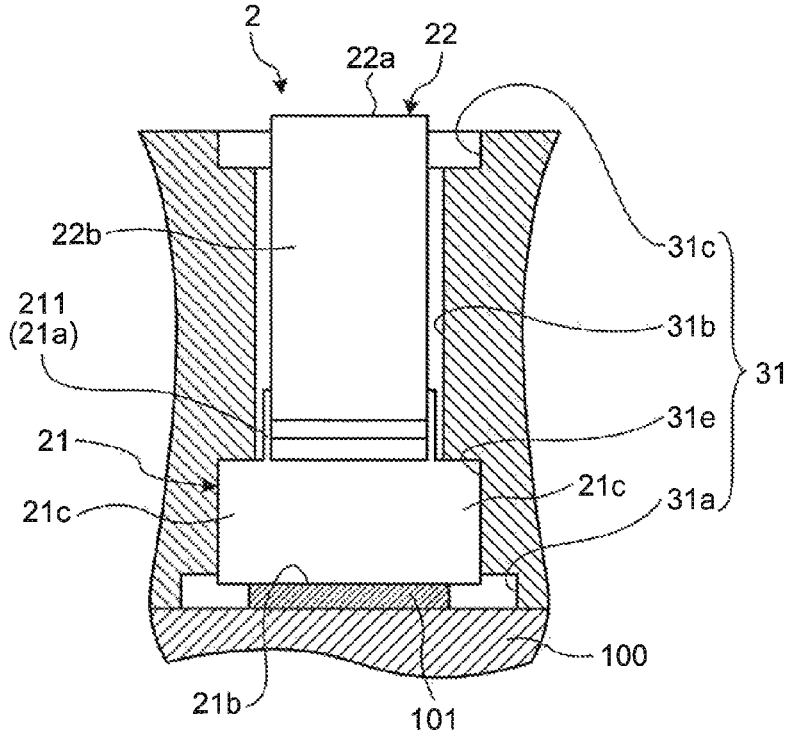
FIG. 4 is a partial cross-sectional view schematically illustrating the configuration of the contact terminal and the contact terminal holder that holds the contact terminal according to the first embodiment of the present invention.

FIG. 2 is a perspective view schematically illustrating a configuration of one of the contact terminals 2 according to the first embodiment. FIGS. 3 and 4 are partial cross-sectional views schematically illustrating a configuration of the contact terminal 2 and the contact terminal holder 3 that holds the contact terminal according to the first embodiment. FIGS. 3 and 4 are the partial cross-sectional views viewed from respective directions orthogonal to each other.

The contact terminal 2 illustrated in FIGS. 2 to 4 conducts electricity between the electrodes 101 and 201 by contacting, at both ends in the longitudinal direction the contact terminal 2, the electrode 101 and the electrode 201 of the substrate 200. The contact terminal 2 is formed using electrically conductive members, and has a first conductive member 21 that contacts the electrode 101, and a second conductive member 22 that contacts and couples with the first conductive member 21 and contacts the electrode 201. The contact terminal 2 is formed using, for example, pure copper or a copper-based material having a spring property.

The first conductive member 21 has a substantially drop-like cross section, and includes a salient portion 21*a* composed of a plurality of inclined surfaces 211 and a first contact portion 21*b* that is provided at an end different from the salient portion 21*a* and contacts the electrode 101. The first conductive member 21 has projecting portions 21*c* that are provided on both side surfaces orthogonal to the inclined surfaces 211 and project in directions orthogonal to the side surfaces.

The second conductive member 22 has a second contact portion 22*a* that has a curved shape and contacts the electrode 201, a plurality of elastic portions 22*b* each of which extends in a band shape along the curved shape from the second contact portion 22*a* and is elastically deformable, and sliding contact portions 22*c* each of which is provided at a leading end of one of the elastic portions 22*b* and slidably contacts the corresponding one of the inclined surfaces 211. The sliding contact portions 22*c* have a shape that curves in the directions opposite to the directions in which the elastic portions 22*b* face each other. The second conductive member 22 has a side face having a substantially Ω-like shape when viewed from the width direction thereof, and is allowed to expand and contract in the lateral direction of the Ω-like shape (directions in which the elastic portions 22*b* face each other) by the elastic portions 22*b*.

In the contact terminal 2, the sliding contact portions 22*c* contact and couple with the inclined surfaces 211 in a direction orthogonal to the expanding/contracting direction of the first conductive member 21. When a load is applied from the first contact portion 21*b* and/or the second contact portion 22*a*, the sliding contact portions 22*c* slide on the inclined surfaces 211. Thereby, a distance (gap) between the sliding contact portions 22*c* increases, and thus, the first conductive member 21 is housed in an Ω-like internal space. This allows the contact terminal 2 to expand and contract in an axis line direction passing through the first and the second contact portions 21*b* and 22*a*. Specifically, the inclined surfaces 211 of the first conductive member 21 can convert an elastic deformation of the second conductive member 22 in the axis line direction passing through the first and the second contact portions 21*b* and 22*a* and an elastic deformation thereof in a direction (pitch direction) orthogonal to the axis line direction into an elastic deformation, that is, a deflection of the contact terminal 2 in the axis line direction.

The contact terminal holder 3 has a substantially plate-like shape formed using an insulating material, such as resin or machinable ceramic, and has holder holes 31 for holding the contact terminals 2 in a predetermined pattern. Each of the holder holes 31 is a space having a step-shaped cross section, and is provided for the corresponding contact terminals 2 to be arranged. The holder hole 31 holds therein the contact terminal 2 so that an end of the contact terminal 2 protrudes from the upper surface of the contact terminal holder 3.

In other words, the internal space of the holder hole 31 penetrates in the thickness direction, and has a stepped hole shape having different diameters along the penetrating direction. The holder hole 31 is composed of a first large-diameter portion 31*a* having an opening on the lower end surface of the contact terminal holder 3, a small-diameter portion 31*b* having a diameter smaller than that of the first large-diameter portion 31*a*, and a second large-diameter portion 31*c* having substantially the same diameter as the diameter of the first large-diameter portion 31*a* and having an opening on the upper end surface of the contact terminal holder 3 (refer to FIGS. 3 and 4). The first large-diameter portion 31*a*, the small-diameter portion 31*b*, and the second large-diameter portion 31*c* are formed so that the axis lines thereof coincide. The first large-diameter portion 31*a* and the second large-diameter portion 31*c* are formed according to the size of the electrode to be housed therein.

The small-diameter portion 31*b* has a reduced diameter portion 31*d* that is provided on the second large-diameter portion 31*c* side and has a reduced diameter along one of the orthogonal directions, and an increased diameter portion 31*e* that is provided on the first large-diameter portion 31*a* side and has an increased diameter along the other of the orthogonal directions. The diameter of the reduced diameter portion 31*d* is smaller than the maximum diameter on the Ω-like side surface side (curved shape) of the second conductive member 22. The diameter of the increased diameter portion 31*e* is substantially the same as a distance between projecting ends of the two projecting portions 21*c*.

In the contact terminal unit 1 according to the first embodiment, the second conductive member 22 is retained by abutting the reduced diameter portion 31*d*, and the projecting portions 21*c* of the first conductive member 21 is latched by the increased diameter portion 31*e* of the contact terminal holder 3. Placing the contact terminal unit 1 on the substrate 100 causes an internal wall surface of the increased diameter portion 31*e* and the upper surface of the substrate 100 to sandwich and fix the projecting portions 21*c* therebetween.

Figure 5:
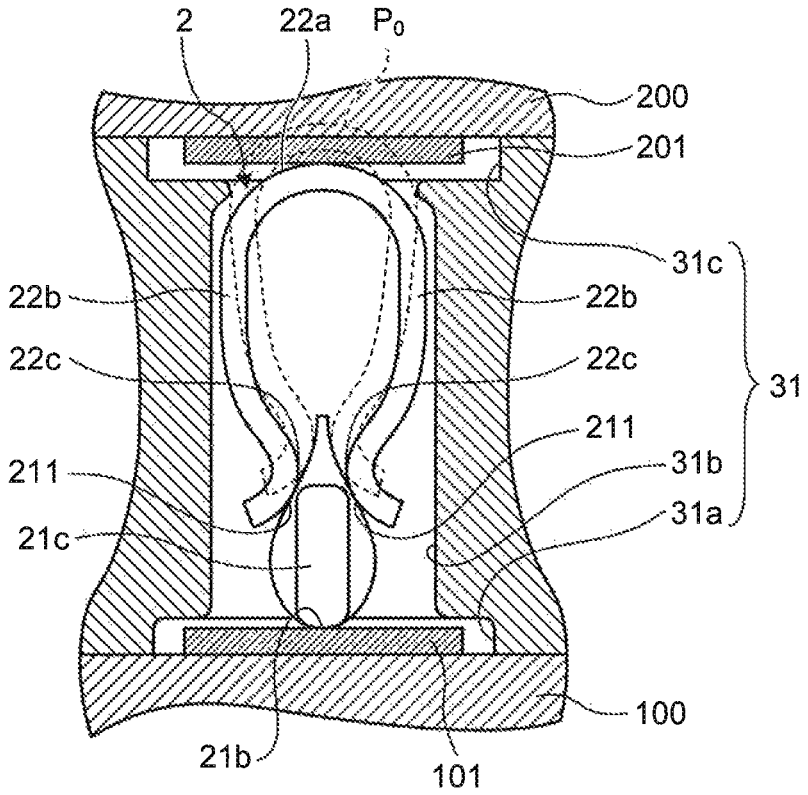
FIG. 5 is a partial cross-sectional view schematically illustrating the configuration of the contact terminal and the contact terminal holder that holds the contact terminal according to the first embodiment of the present invention.

FIG. 5 is a partial cross-sectional view schematically illustrating the configuration of the contact terminal 2 and the contact terminal holder 3 according to the first embodiment and illustrating a state in which a load is applied to the second contact portion 22*a* or the first contact portion 21*b*. As illustrated in FIG. 5, when the first contact portion 21*b* contacts the electrode 101 of the substrate 100 to apply the load, the elastic portions 22*b* of the second conductive member 22 are elastically deformed, so that a diameter between the sliding contact portions 22*c* increases along a diameter between the inclined surfaces 211. At this time, the sliding contact portions 22*c* house the first conductive member 21 in the Ω-like internal space of the second conductive member 22 while slidably contacting the inclined surfaces 211. The contact terminal 2 contracts in the axis line direction passing through the second and the first contact portions 22*a* and 21*b*. A dashed line P0 indicates the position of the contact terminal 2 in the state in which the load is not applied from the substrate 200 (refer to FIG. 3). In the second conductive member 22, a current flows in both paths connecting the second contact portion 22*a* to the sliding contact portions 22*c*, so that a large conducting cross-sectional area can be ensured, allowing a large current to flow.

When the contact terminal 2 contracts in the axis line direction passing through the first and the second contact portions 21*b* and 22*a* by receiving the load from the substrate 200, the elastic portions 22*b* apply forces to restore the original shapes thereof, so that a load is applied in the direction of separating the first contact portion 21*b* from the second contact portion 22*a* while the contact terminal 2 contracts in the axis line direction. In other words, the contact terminal 2 is in the state of contracting in the axis line direction while the first and the second contact portions 21*b* and 22*a* apply the load toward the substrates 100 and 200 respectively (press the substrates). When vibration occurs to change the distance between the substrates 100 and 200, this pressing state allows the contact terminal 2 to follow the change and maintain the conduction state between the substrates 100 and 200.

Figure 6:
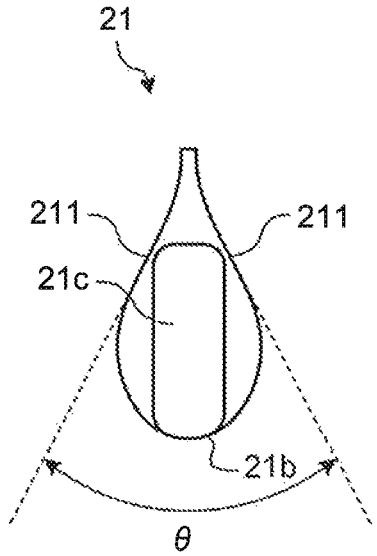
FIG. 6 is a partial cross-sectional view schematically illustrating a configuration of an essential part of the contact terminal according to the first embodiment of the present invention.

At this time, an angle θ formed by the two inclined surfaces 211 satisfies a relation $\tan(\theta/2) \geq \mu$ (refer to FIG. 6), where μ represents a coefficient of friction between the inclined surfaces 211 and the sliding contact portions 22*c* at the contact portion thereof. For example, when the contact terminal 2 is formed using a copper-based material and the coefficient of friction μ satisfies $\mu=0.2$, the angle θ has a value satisfying $\theta \geq 22.8°$ ($\theta/2 \geq 11.4°$) that is derived from $\tan(\theta/2) \geq 0.2$.

When $\theta \leq 22.8°$, the load applied by the sliding contact portions 22*c* to the inclined surfaces 211 when the elastic portions 22*b* are restoring the original shapes thereof is smaller than a frictional force between the sliding contact portions 22*c* and the inclined surfaces 211. This fixes the contact terminal 2 between the sliding contact portions 22*c* and the inclined surfaces 211. Thus, the contact terminal 2 cannot maintain the state of pressing the substrates (electrodes). As a result, the contact terminal 2 can be incapable of following the movement of the substrates caused by, for example, vibration. Thus, θ is preferably 30° or more (less than 180°).

According to the first embodiment, the contact terminal 2 formed using the electrically conductive members expands and contracts in the axis line direction passing through the first and the second contact portions 21*b* and 22*a* while housing the first conductive member 21 in the internal space of the second conductive member 22. This can achieve downsizing while maintaining required characteristics, such as elasticity and conductivity.

The second conductive member 22 of the contact terminal 2 is formed using the band-like member, and thus can have a large cross-sectional area in a direction orthogonal to a plate shaped surface. The second conductive member 22 is curved in the Ω-like shape, and thus has the conductive paths in two directions. This can provide a larger cross-sectional area for electrical conduction. This reduces the conductor resistance, which allows a large current flow and a reduced resistance heat generation. The first conductive member 21 of the contact terminal 2 has the drop-like shape, and thereby can provide a large cross-sectional area for electrical conduction in the same manner as the above-described second conductive member 22. This reduces the conductor resistance, which allows a large current flow and a reduced resistance heat generation.

The second conductive member 22 of the contact terminal 2 contacts the electrode 201 of the substrate 200 at the top of the Ω-like shape, and the path connected to one end side of the contact terminal 2 serve as the paths for electrical conduction. This can make the path for electrical conduction shorter than a conventional path for electrical conduction that connects one end to the other end in the longitudinal direction of a band-like member. This reduces the conductor resistance, which allows a large current flow and a reduced resistance heat generation.

The first and the second conductive members of the contact terminal 2 contact and couple with each other by slidably contacting at the inclined surfaces 211 and the sliding contact portions 22*c*. The sliding contact portions 22*c* contact the inclined surfaces 211 in a wedging manner. This wedge-like coupling state makes the contact resistance smaller than that in a contact state in which flat surfaces abut and contact each other.

Provided that the contact conduction between the first and the second conductive members 21 and 22 is ensured, the shapes of the elastic portions 22*b* of the second conductive member 22 extending along the curved shapes from the second contact portion 22*a* may be the same or different (e.g., different in thickness, or different in the length of extension from the second contact portion 22*a*). The shapes having the same shape along the curved shapes are symmetrical shapes with respect to the axis line passing through the first and the second contact portions 21*b* and 22*a* in the state in which the first and the second conductive members 21 and 22 are coupled with each other. The term "same shapes" refers to shapes that are the same in design, and include manufacturing errors.

To stabilize the current flowing through the elastic portions 22*b*, the elastic portions 22*b* of the second conductive member 22 preferably have the same cross-sectional area.

When the shapes of the elastic portions 22*b* of the second conductive member 22 extending along the curved shapes from the second contact portion 22*a* are the same, the elastic portions 22*b* have the same resistance and the same current flows through the elastic portions 22*b*. This allows a larger current to flow. When the elastic portions 22*b* have the same shape, the second conductive member 22 makes smooth expansion and contraction, and more stable expansion and contraction of the contact terminal 2 can be obtained.

Figure 7:
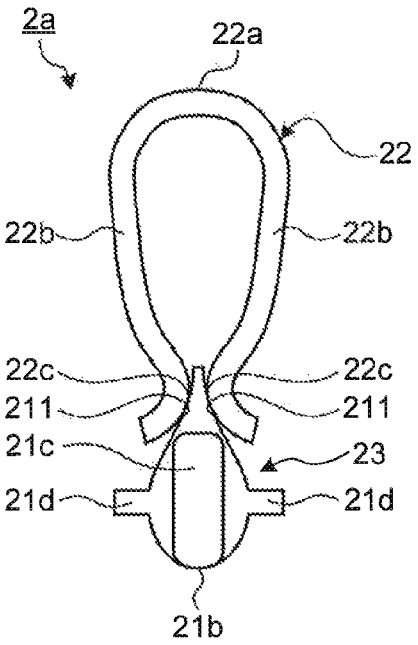
FIG. 7 is a side view schematically illustrating a configuration of a contact terminal according to a first modification of the first embodiment of the present invention.

FIG. 7 is a side view schematically illustrating a configuration of a contact terminal according to a first modification of the first embodiment. As illustrated in a contact terminal 2*a* in FIG. 7, a first conductive member 23 may have restricting portions 21*d*, in addition to the inclined surfaces 211 (salient portion 21*a*), the first contact portion 21*b*, and the projecting portions 21*c* described above. The restricting portions 21*d* are formed between the inclined surfaces 211 and the first contact portion 21*b*, and each has a shape projecting in a direction orthogonal to the projecting portions 21*c*. The restricting portions 21*d* restrict the movement amount of the second conductive member 22 relative to the first conductive member 21. Forming positions of the restricting portions 21*d* can be set to any position because of the movement amount of the second conductive member 22 relative to the first conductive member 23.

Figure 8:
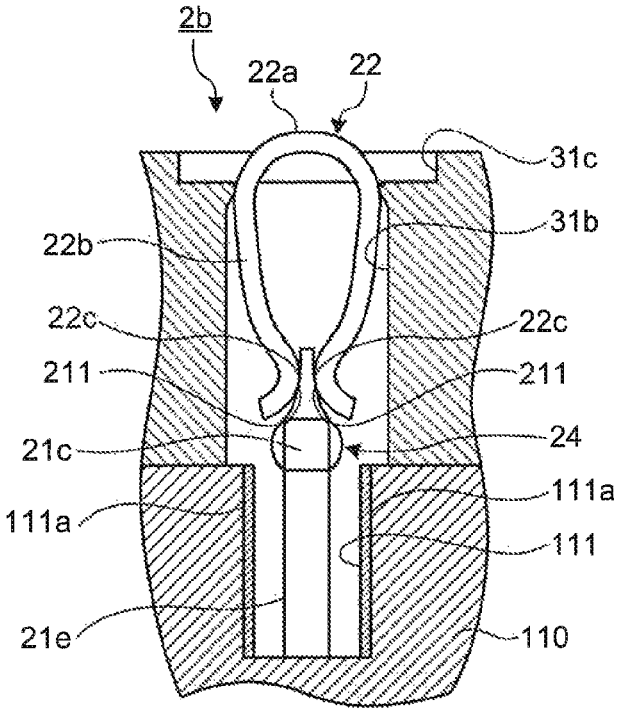
FIG. 8 is a partial cross-sectional view schematically illustrating a configuration of a contact terminal and a contact terminal holder that holds the contact terminal according to a second modification of the first embodiment of the present invention.
Figure 9:
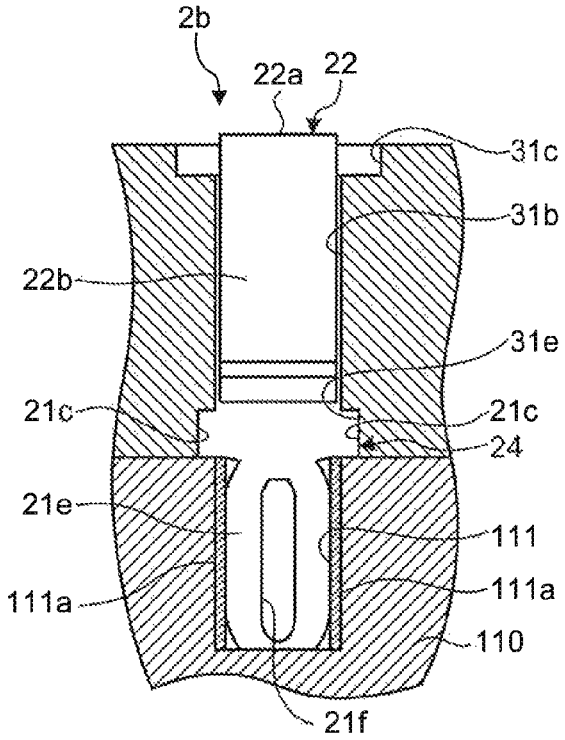
FIG. 9 is a partial cross-sectional view schematically illustrating the configuration of the contact terminal and the contact terminal holder that holds the contact terminal according to the second modification of the first embodiment of the present invention.

FIGS. 8 and 9 are partial cross-sectional views schematically illustrating a configuration of a contact terminal and a contact terminal holder that holds the contact terminal according to a second modification of the first embodiment. FIGS. 8 and 9 are the partial cross-sectional views viewed from respective directions orthogonal to each other. When the terminal and the holder contact a hollow portion 111 with an electrode 111*a* formed on the surface thereof as with a substrate 110 according to the second modification, a contact terminal 2*b* illustrated in FIGS. 8 and 9 may include, instead of the first conductive member 21, a first conductive member 24 that has a first contact portion 21*e* press-fitted into the hollow portion 111 and contacting the electrode 111*a*, in addition to the inclined surfaces 211 (salient portion 21*a*) and the projecting portions 21*c* described above.

The first contact portion 21e is provided at an end on the side different from the inclined surfaces 211 (salient portion 21*a*) in the longitudinal direction of the first conductive member 24, and has a plate shape extending in the longitudinal direction with the same width as that of the side surface from which the inclined surfaces 211 are formed. A hole portion 21*f* running through in the direction orthogonal to the plate shaped surface is formed in the first contact portion 21*e*. The shape of the hole portion 21*f* changes according to an externally applied load, which in turn maintains the first contact portion 21*e* in the state of being press-fitted into the hollow portion 111, and joins together the substrate 110 and the first conductive member 24 (this structure is commonly called a "press-fit" structure). The press-fit structure further strengthens the fixation between the substrate 110 and the first conductive member 24. In this case, the contact terminal holder does not have the first large-diameter portion 31*a*.

Figure 10:
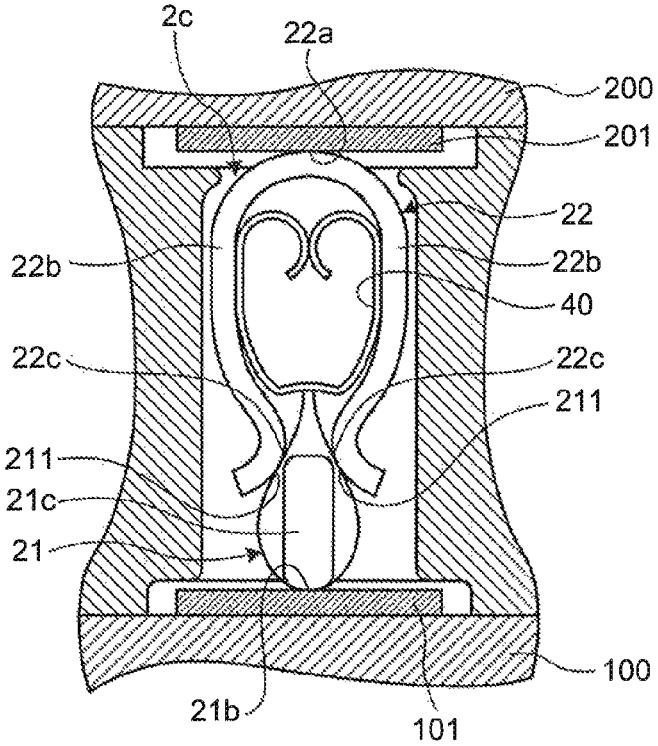
FIG. 10 is a partial cross-sectional view schematically illustrating a configuration of a contact terminal and a contact terminal holder that holds the contact terminal according to a third modification of the first embodiment of the present invention.
Figure 11:
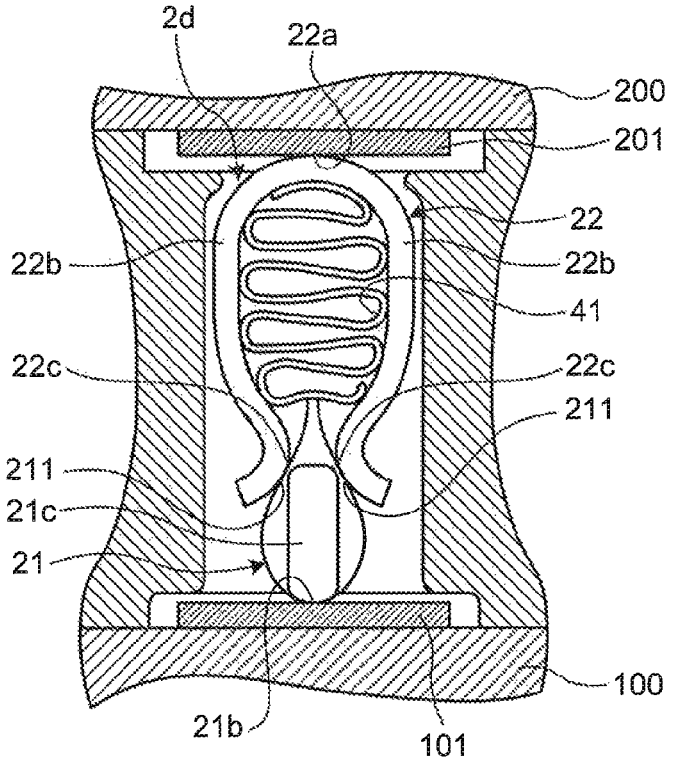
FIG. 11 is a partial cross-sectional view schematically illustrating a configuration of a contact terminal and a contact terminal holder that holds the contact terminal according to a fourth modification of the first embodiment of the present invention.

FIG. 10 is a partial cross-sectional view schematically illustrating a configuration of a contact terminal and a contact terminal holder that holds the contact terminal according to a third modification of the first embodiment. FIG. 11 is a partial cross-sectional view schematically illustrating a configuration of a contact terminal and a contact terminal holder that holds the contact terminal according to a fourth modification of the first embodiment. To further ensure the state of pressing the substrates contacting both ends of any of the contact terminals describe above, an elastic member may be arranged in the above-described second conductive member 22.

A contact terminal 2*c* illustrated in FIG. 10 includes an elastic member 40 arranged in the Ω-like shape of the second conductive member 22 (area surrounded by the first and the second conductive members 21 and 22), in addition to the first and the second conductive members 21 and 22 described above. The elastic member 40 is formed using a band-like member made of, for example, spring steel, stainless steel, a copper-based material, or a resin material. A middle portion in the longitudinal direction of the elastic member 40 is curved along the plate surface, and the ends in the longitudinal direction of the elastic member 40 have curved shapes so as to be housed inside the curves.

The curved portion formed by curving the band-like middle portion of the elastic member 40 contacts an end on the side opposite to the first contact portion 21*b* of the first conductive member 21. When the second conductive member 22 moves toward the first conductive member 21 in response to the load from the substrate 200, the elastic member 40 contracts by being sandwiched between the first and the second conductive members 21 and 22. At this time, a restoring force of the elastic member 40 causes the elastic member 40 to apply a load in the direction of separating the first and the second conductive members 21 and 22.

A contact terminal 2*d* illustrated in FIG. 11 includes an elastic member 41 arranged in the Ω-like shape of the second conductive member 22 (area surrounded by the first and the second conductive members 21 and 22), in addition to the first and the second conductive members 21 and 22 described above. The elastic member 41 is formed using a band-like member made of, for example, spring steel, stainless steel, a copper-based material, or a resin material, and extends in a zigzag manner by repeating curved portions curved in opposite directions.

A surface on one end in the direction of extension of the zigzag shape of the elastic member 41 contacts the end on the side opposite to the first contact portion 21*b* of the first conductive member 21, and a surface on the other end thereof contacts the inner peripheral surface of the second conductive member 22. When the second conductive member 22 moves toward the first conductive member 21 in response to the load from the substrate 200, the elastic member 41 contracts by being sandwiched between the first and the second conductive members 21 and 22. At this time, a restoring force of the elastic member 41 causes the elastic member 41 to apply a load in the direction of separating the first and the second conductive members 21 and 22.

The third and the fourth modifications described above allow the contact terminal to follow the movement of the substrates caused by, for example, vibration in a more reliable manner than the first embodiment described above, without an extra installation space. The elastic member can employ a material that does not affect the conduction of the first and the second conductive members, such as a material having higher resistivity than that of the first and the second conductive members.

Figure 12:
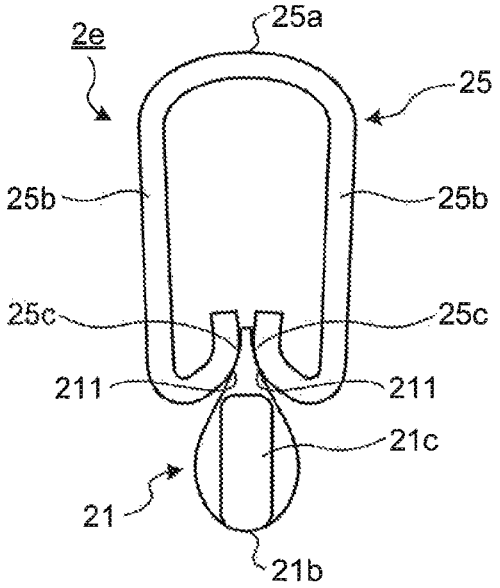
FIG. 12 is a partial cross-sectional view schematically illustrating a configuration of a contact terminal according to a fifth modification of the first embodiment of the present invention.

FIG. 12 is a partial cross-sectional view schematically illustrating a configuration of a contact terminal according to a fifth modification of the first embodiment. In the fifth modification, a contact terminal 2*e* includes the above-described first conductive member 21 and a second conductive member 25 having a curved shape different from that of the sliding contact portions 22*c*, instead of the above-described second conductive member 22.

The second conductive member 25 has a second contact portion 25*a* that has a curved shape and contacts the electrode 201, a plurality of elastic portions 25*b* that extend in the same band shape along curved shapes from the second contact portion 25*a* and are elastically deformable, and sliding contact portions 25*c* each of which is provided at a leading end of one of the elastic portions 25*b* and slidably contacts the corresponding one of the inclined surfaces 211. The sliding contact portions 25*c* have shapes that curve in the directions in which the elastic portions 25*b* face each other. The second conductive member 25 can expand and contract in the directions in which the elastic portions 25*b* face each other, according to an externally applied load.

In the same manner as with the first embodiment, in the above-described contact terminal according to the fifth modification, provided that the contact conduction between the first and the second conductive members 21 and 25 is ensured, the shapes of the elastic portions 25*b* of the second conductive member 25 extending along the curved shapes from the second contact portion 25*a* may be the same or different (e.g., different in thickness, or different in the length of extension from the second contact portion 25*a*). To stabilize the current flowing through the elastic portions 25*b*, the elastic portions 25*b* preferably have the same cross-sectional area.

The second conductive member 25 according to the fifth modification is applicable to the above-described first to fourth modifications.

Second Embodiment

Figure 13:
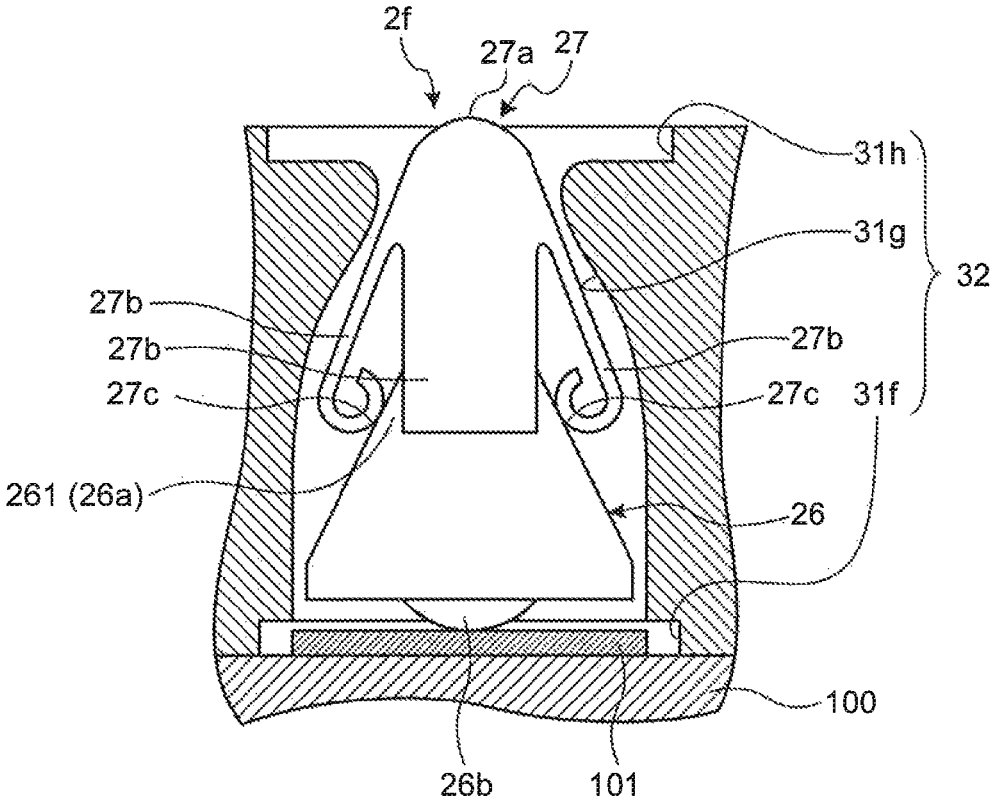
FIG. 13 is a partial cross-sectional view schematically illustrating a configuration of a contact terminal and a contact terminal holder that holds the contact terminal according to a second embodiment of the present invention.

Next, a second embodiment of the present invention will be described with reference to FIG. 13. FIG. 13 is a partial cross-sectional view schematically illustrating a configuration of a contact terminal and a contact terminal holder that holds the contact terminal according to the second embodiment of the present invention. This contact terminal 2*f* and the contact terminal holder illustrated in FIG. 13 are interposed between the two contact targets so as to provide the electrical conduction between the two contact targets. The same reference signs are given to the same components as those of the contact terminals illustrated above in FIG. 1 and the other drawings.

The contact terminal 2*f* conducts electricity between the electrodes 101 and 201 by contacting, at both ends in the longitudinal direction thereof, the electrode 101 and the electrode 201 of the substrate 200. The contact terminal 2*f* is formed using electrically conductive members, and has a first conductive member 26 that contacts the electrode 101, and a second conductive member 27 that contacts and couples with the first conductive member 26 and contacts the electrode 201. The contact terminal 2*f* is formed using, for example, pure copper or a copper-based material having a spring property.

Figure 14:
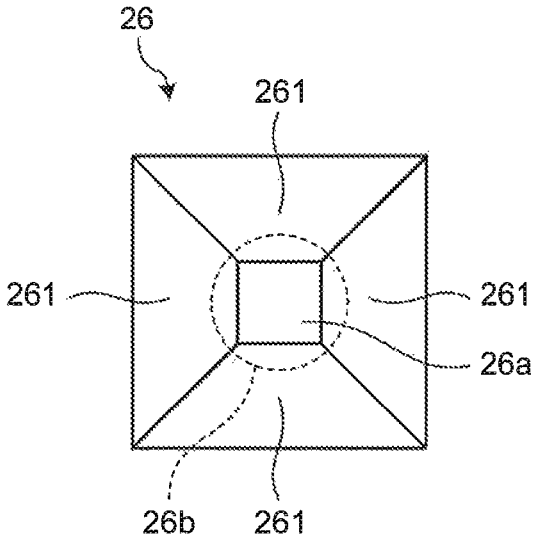
FIG. 14 is a top view schematically illustrating a configuration of an essential part of the contact terminal according to the second embodiment of the present invention.

FIG. 14 is a top view illustrating a configuration of the first conductive member 26 of the contact terminal according to the second embodiment. FIG. 14 is a view of the first conductive member 26 illustrated in FIG. 13, as viewed from the upper side of FIG. 13. The first conductive member 26 is substantially pyramid-shaped, and has a substantially pyramid-shaped salient portion 26*a* composed of a plurality of (in the second embodiment, four) inclined surfaces 261 and a substantially hemispherical first contact portion 26*b* that is provided at an end different from the salient portion 26*a* and contacts the electrode 101. An angle formed by an opposed pair of the inclined surfaces 261 preferably satisfies the relation for θ given above.

Figure 15:
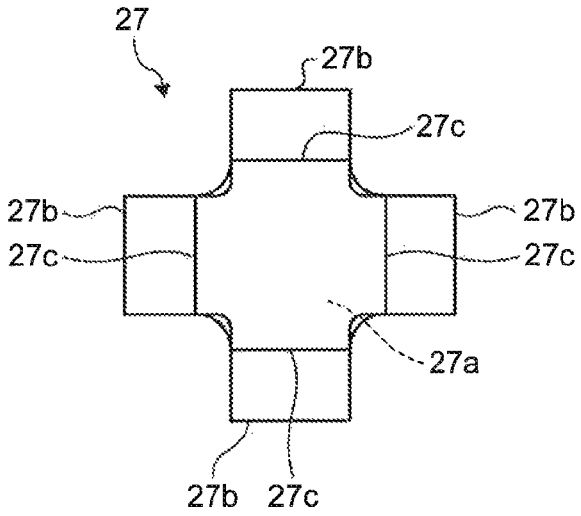
FIG. 15 is a bottom view schematically illustrating a configuration of an essential part of the contact terminal according to the second embodiment of the present invention.

FIG. 15 is a bottom view illustrating a configuration of the second conductive member 27 of the contact terminal according to the second embodiment. FIG. 15 is a view of the second conductive member 27 illustrated in FIG. 13, as viewed from the lower side of FIG. 13. The second conductive member 27 illustrated in FIGS. 13 and 15 has a second contact portion 27*a* that has a curved shape and contacts the electrode 201, a plurality of (in the second embodiment, four) elastic portions 27*b* that extend in the same band shape along curved shapes from the second contact portion 27*a* and are elastically deformable, and sliding contact portions 27*c* each of which is provided at a leading end of one of the elastic portions 27*b* and slidably contacts the corresponding one of the inclined surfaces 261. The sliding contact portions 27*c* have shapes that curve in the directions in which the elastic portions 27*b* face each other. The second conductive member 27 can expand and contract in the directions in which the elastic portions 27*b* face each other, according to an externally applied load.

In the contact terminal 2*f*, the sliding contact portions 27*c* contact and couple with the inclined surfaces 261 in directions orthogonal to the expanding/contracting direction of the second conductive member 27. When a load is applied from the first contact portion 26*b* and/or the second contact portion 27*a*, the sliding contact portions 27*c* slide on the inclined surfaces 261. Thereby, a diameter between each pair of the sliding contact portions 27*c* increases along a diameter between each pair of the inclined surfaces 261, and thus, the first conductive member 26 is housed in an Ω-like internal space. This allows the contact terminal 2*f* to expand and contract in the axis line direction passing through the first and the second contact portions 26*b* and 27*a*.

The contact terminal holder has a substantially plate-like shape formed using an insulating material, such as resin or machinable ceramic, and has holder holes 32 for holding the contact terminals 2*f* in a predetermined pattern. Each of the holder holes 32 is a space having a step-shaped cross section, and is provided for the corresponding contact terminals 2*f* to be arranged. The holder hole 32 holds therein the contact terminal 2*f* so that an end of the contact terminal 2*f* protrudes from the upper surface of the contact terminal holder.

In other words, the internal space of the holder hole 32 penetrates in the thickness direction, and has a stepped hole shape having different diameters along the penetrating direction. The holder hole 32 is composed of a first large-diameter portion 31*f* having an opening on the lower end surface of the contact terminal holder 3, a small-diameter portion 31*g* having a diameter smaller than that of the first large-diameter portion 31*f*, and a second large-diameter portion 31*h* having substantially the same diameter as the diameter of the first large-diameter portion 31*f* and having an opening on the upper end surface of the contact terminal holder 3 (refer to FIG. 13). The first large-diameter portion 31*f*, the small-diameter portion 31*g*, and the second large-diameter portion 31*h* are formed so that the axis lines thereof coincide. The first large-diameter portion 31*f* and the second large-diameter portion 31*h* are formed according to the size of the electrode to be housed therein.

The small-diameter portion 31*g* has a reduced diameter at an end on the second large-diameter portion 31*h* side. The diameter of this portion having the reduced diameter is smaller than the maximum distance between each opposed pair of the sliding contact portions 27*c* of the second conductive member 27. The holder hole 32 provides a function such that the second conductive member 27 abuts the reduced diameter portion so as to be prevented from coming out from the contact terminal holder.

Figure 16:
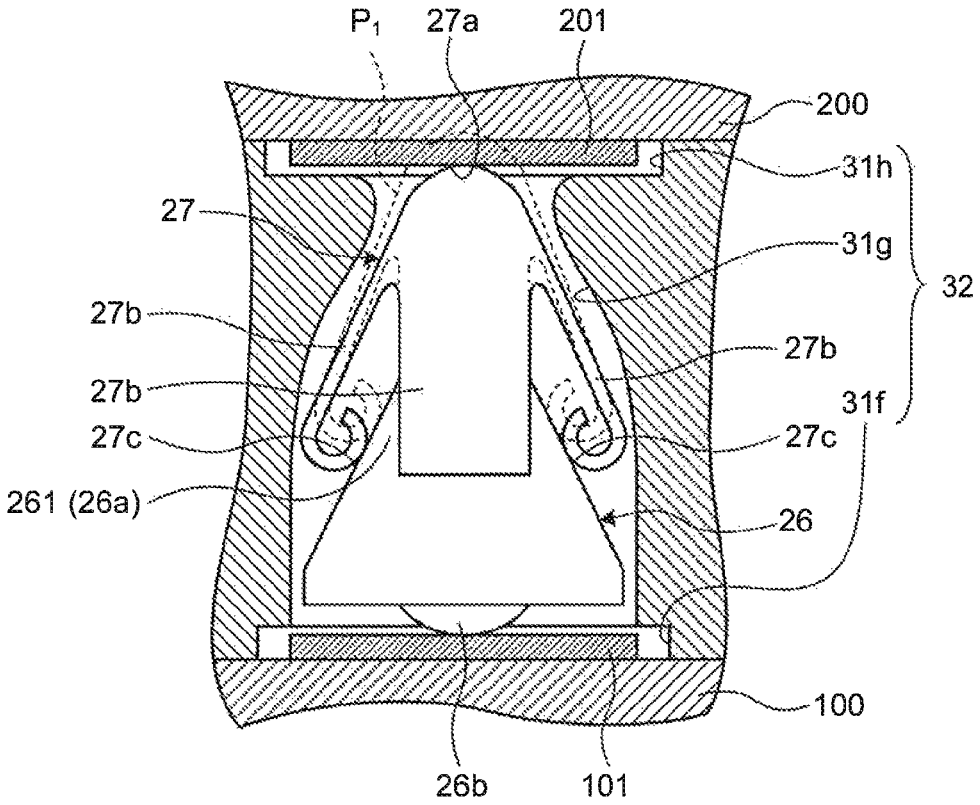
FIG. 16 is a partial cross-sectional view schematically illustrating the configuration of the contact terminal and the contact terminal holder that holds the contact terminal according to the second embodiment of the present invention.

FIG. 16 is a partial cross-sectional view illustrating a state in which a load is applied to the first contact portion 26*b* or the second contact portion 27*a*. As illustrated in FIG. 16, when the second contact portion 27*a* contacts the electrode 201 of the substrate 200 to apply the load, the elastic portions 27*b* of the second conductive member 27 are elastically deformed, so that the diameter between each pair of the sliding contact portions 27*c* increases along the diameter between each pair of the inclined surfaces 261. At this time, the sliding contact portions 27*c* house the first conductive member 26 in the internal space of the second conductive member 27 while slidably contacting the inclined surfaces 261. At this time, the contact terminal 2*f* contracts in the axis line direction passing through the first and the second contact portions 26*b* and 27*a*. A dashed line P1 indicates the position of the contact terminal 2*f* in the state in which the load is not applied from the substrate 200 (refer to FIG. 13). In the second conductive member 27, a current mostly flows in any one of paths connecting the second contact portion 27*a* to the sliding contact portions 27*c*.

When the contact terminal 2*f* contracts in the axis line direction passing through the first and the second contact portions 26*b* and 27*a* by receiving the load from the substrate 200, the elastic portions 27*b* apply forces to restore the original shapes thereof, so that a load is applied in the direction of separating the first contact portion 26*b* from the second contact portion 27*a* while the contact terminal 2*f* contracts in the axis line direction. In other words, the contact terminal 2*f* is in the state of contracting in the axis line direction while the first and the second contact portions 26*b* and 27*a* apply the load toward the substrates 100 and 200 respectively (press the substrates). When vibration occurs to change the distance between the substrates 100 and 200, this pressing state allows the contact terminal 2*f* to follow the change and maintain the conduction state between the substrates 100 and 200.

According to the second embodiment, in the same manner as in the first embodiment, the contact terminal 2*f* formed using the electrically conductive members expands and contracts in the axis line direction passing through the first and the second contact portions 26*b* and 27*a* while housing the first conductive member 26 in the internal space of the second conductive member 27. This can achieve downsizing while maintaining the required characteristics, such as elasticity and conductivity.

According to the second embodiment, the conductive paths are provided in four directions, so that a larger cross-sectional area for electrical conduction is obtained than that of the first embodiment. This reduces the conductor resistance, which allows a large current flow and a reduced resistance heat generation.

A contact portion having a press-fit structure as illustrated in the second modification of the first embodiment can be used as the first contact portion 26*b* of the first conductive member 26 according to the second embodiment.

Figure 17:
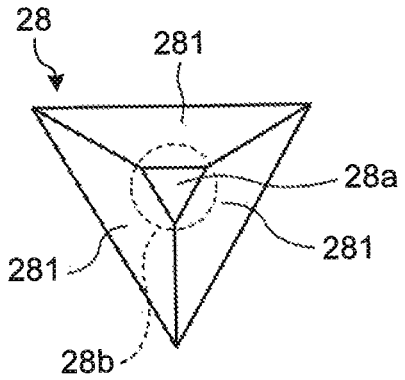
FIG. 17 is a top view schematically illustrating a configuration of an essential part of a contact terminal according to a modification of the second embodiment of the present invention.
Figure 18:
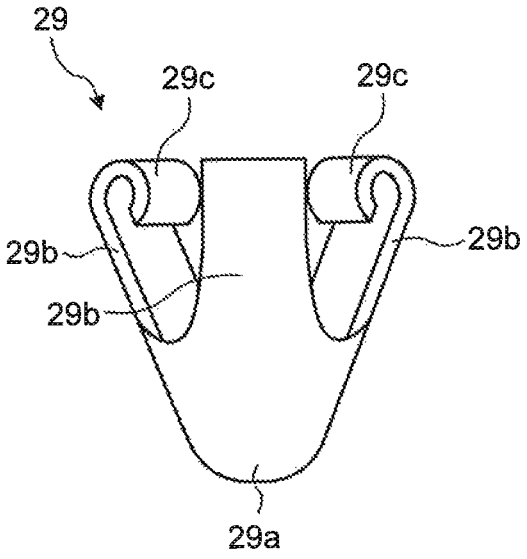
FIG. 18 is a side view schematically illustrating a configuration of an essential part of the contact terminal according to the modification of the second embodiment of the present invention.
Figure 19:
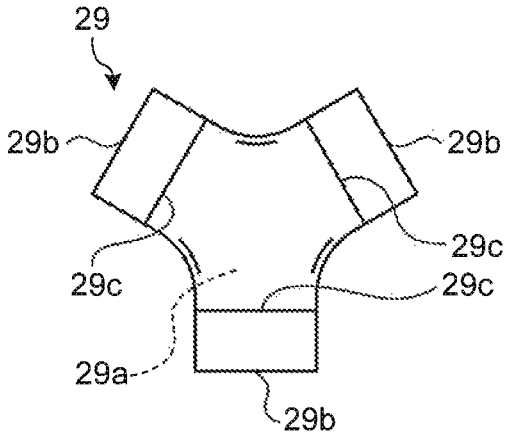
FIG. 19 is a bottom view schematically illustrating the configuration of the essential part of the contact terminal according to the modification of the second embodiment of the present invention.

FIG. 17 is a top view schematically illustrating a configuration of an essential part of a contact terminal according to a modification of the second embodiment. FIG. 18 is a side view schematically illustrating a configuration of an essential part of the contact terminal according to the modification of the second embodiment. FIG. 19 is a bottom view schematically illustrating the configuration of the essential part of the contact terminal according to the modification of the second embodiment. FIG. 17 is a view of a first conductive member as viewed from the same direction as FIG. 14. FIG. 19 is a view of a second conductive member as viewed from the same direction as FIG. 15. In the above-described second embodiment, the second conductive member has been described as having the four elastic portions 27*b* that extend in the same band shape along the curved shapes from the second contact portion 27*a*. However, the second conductive member may have three elastic portions that extend in the same band shape along curved shapes from the second contact portion, as illustrated in the modification.

A first conductive member 28 illustrated in FIG. 17 is substantially pyramid-shaped, and has a substantially pyramid-shaped salient portion 28*a* composed of three inclined surfaces 281 and a substantially hemispherical first contact portion 28*b* that is provided at an end different from the salient portion 28*a* and contacts the electrode 101.

A second conductive member 29 illustrated in FIGS. 18 and 19 has a second contact portion 29*a* that has a curved shape and contacts the electrode 201, three elastic portions 29*b* that extend in the same band shape along curved shapes from the second contact portion 29*a* and are elastically deformable, and sliding contact portions 29*c* each of which is provided at a leading end of one of the elastic portions 29*b* and slidably contacts the corresponding one of the inclined surfaces 281. The sliding contact portions 29*c* have a shape that curves in the directions in which the elastic portions 29*b* face each other. The second conductive member 29 can expand and contract in the directions in which the elastic portions 29*b* face each other, according to an externally applied load.

Between the first and the second conductive members 28 and 29, the sliding contact portions 29*c* contact and couple with the inclined surfaces 281 in directions orthogonal to the expanding/contracting direction of the second conductive member 29, in the same manner as with the contact terminal 2*f* illustrated in FIG. 13. When a load is applied from the first contact portion 28*b* and/or the second contact portion 29*a*, the sliding contact portions 29*c* slide on the inclined surfaces 281. Thereby, a diameter on the sliding contact portions 29*c* side of the second conductive member 29 increases, and thus, the first conductive member 28 is housed in an internal space. This allows the contact terminal to expand and contract in the axis line direction passing through the first and the second contact portions 28*b* and 29*a*.

INDUSTRIAL APPLICABILITY

As described above, the contact terminal according to the present invention is useful for achieving downsizing while maintaining the required characteristics, such as elasticity and conductivity.

REFERENCE SIGNS LIST

1 Contact terminal unit
2, 2*a*, 2*b*, 2*c*, 2*d*, 2*e*, 2*f* Contact terminal
3 Contact terminal holder
21, 23, 24, 26, 28 First conductive member
21*a*, 26*a*, 28*a* Salient portion
21*b*, 21*e*, 26*b*, 28*b* First contact portion
21*c* Projecting portion
21*d* Restricting portion
21*f* Hole portion
22, 25, 27, 29 Second conductive member
22*a*, 25*a*, 27*a*, 29*a* Second contact portion
22*b*, 25*b*, 27*b*, 29*b* Elastic portion
22*c*, 25*c*, 27*c*, 29*c* Sliding contact portion
31, 32 Holder hole
31*a*, 31*f* First large-diameter portion
31*b*, 31*g* Small-diameter portion
31*c*, 31*h* Second large-diameter portion
31*d* Reduced diameter portion
31*e* Increased diameter portion
40, 41 Elastic member
100, 110, 200 Substrate
101, 201, 111*a* Electrode
111 Hollow portion
211, 261, 281 Inclined surface

The invention claimed is:

1. A contact terminal interposed between two contact targets so as to provide electrical conduction between the two contact targets, the contact terminal comprising:

a first conductive member comprising a salient portion composed of a plurality of inclined surfaces, and a first contact portion that is provided at an end different from the salient portion and contacts an electrode of one of the contact targets; and a second conductive member comprising a second contact portion that has a curved shape and contacts an electrode of another one of the contact targets, a plurality of elastic portions each of which extends in a band shape along the curved shape from the second contact portion and is elastically deformable, and sliding contact portions each of which is provided at a leading end of one of the elastic portions and slidably contacts a corresponding one of the inclined surfaces, wherein an angle θ formed by the inclined surfaces satisfies a relation $\tan(\theta/2) \geq \mu$, where μ represents a coefficient of friction between the inclined surfaces and the sliding contact portions.

2. The contact terminal according to claim 1, wherein the elastic portions extend along the curved shape from the second contact portion in a same shape.

3. The contact terminal according to claim 1, wherein one of the inclined surfaces and another one of the inclined surfaces form an angle of 30° or more.

4. The contact terminal according to claim 1, wherein the first conductive member comprises a restricting portion that is provided between the inclined surfaces and the first contact portion, and projects from the inclined surface side to restrict a movement amount of the second conductive member.

5. The contact terminal according to claim 1, wherein the one of the contact targets comprises a hollow portion with an electrode formed on a surface of the hollow portion, and the first contact portion extends in a plate shape with a same width as that of the hollow portion, and comprises a hole portion running through in a direction orthogonal to a surface of the plate shape.

6. The contact terminal according to claim 1, further comprising an elastic member that is arranged in an area surrounded by the first and the second conductive members in a state in which the first and the second conductive members contact each other, and applies a pressing force toward the first and the second conductive members.

* * * * *